US008393923B2

(12) United States Patent
Alzemi

(10) Patent No.: US 8,393,923 B2
(45) Date of Patent: Mar. 12, 2013

(54) MARINE PROPULSION ASSEMBLY

(76) Inventor: Mohammad A. Alzemi, Mubarak Alkabeer (KW)

( * ) Notice: Subject to any disclaimer, the term of this patent is extended or adjusted under 35 U.S.C. 154(b) by 133 days.

(21) Appl. No.: 13/116,408

(22) Filed: May 26, 2011

(65) Prior Publication Data

US 2012/0302113 A1 Nov. 29, 2012

(51) Int. Cl.
*B63H 1/14* (2006.01)

(52) U.S. Cl. ..... 440/49; 440/80; 416/93 A; 416/243

(58) Field of Classification Search ..... 440/49, 440/80; 416/93 A, 243
See application file for complete search history.

(56) References Cited

U.S. PATENT DOCUMENTS

| | | | | |
|---|---|---|---|---|
| 1,860,750 | A * | 5/1932 | Riggs | 464/39 |
| 2,978,040 | A * | 4/1961 | Wirkkala | 416/228 |
| 3,112,728 | A | 12/1963 | Krause | |
| 3,924,557 | A | 12/1975 | Bloch | |
| 4,645,463 | A * | 2/1987 | Arneson | 440/57 |
| 4,767,278 | A * | 8/1988 | Enderlein, Jr. | 416/241 B |
| 4,846,741 | A * | 7/1989 | Betsinger | 440/57 |
| 5,114,313 | A | 5/1992 | Vorus | |
| 5,549,493 | A * | 8/1996 | Bezzi | 440/61 R |
| 6,247,897 | B1 * | 6/2001 | Patel | 416/197 R |
| 6,332,818 | B1 * | 12/2001 | Duncan et al. | 440/66 |
| 6,544,081 | B1 | 4/2003 | Paulo | |
| 6,699,016 | B1 | 3/2004 | Dean | |
| 6,749,401 | B2 * | 6/2004 | Vanmoor | 416/228 |
| 6,823,812 | B2 * | 11/2004 | von Wolske | 114/286 |
| 7,025,642 | B1 * | 4/2006 | Baylor | 440/49 |
| 7,153,101 | B2 | 12/2006 | Mansson | |
| 2007/0065282 | A1 * | 3/2007 | Patterson | 416/93 A |

* cited by examiner

*Primary Examiner* — Stephen Avila
(74) *Attorney, Agent, or Firm* — Lowe Hauptman Ham & Berner, LLP

(57) ABSTRACT

A marine propulsion assembly comprises or consists of a marine engine, a pair of parallel laterally spaced propeller shafts and a pair of marine propellers with one of the propeller fixed to each of the shafts for rotation. Each of the propellers includes a hub and four equally spaced blades and wherein the hub has a forward portion having the shape of a frustum of a cone with a decreasing radius from a forward edge thereof to the middle of the hub and a rear or second continuous portion having the shape of a frustum of a cone with an increasing radius from the middle of the hub to the rear of the hub. The bases or larger ends of the frustums are of equal size as are the tops of the frustums. In addition, each of the blades has a complex concave shape.

11 Claims, 5 Drawing Sheets

MARINE PROPULSION ASSEMBLY

FIELD OF THE INVENTION

This invention relates to a marine propulsion assembly and more particularly to a marine propulsion system that has a pair of propellers driven by a single marine engine.

BACKGROUND FOR THE INVENTION

Marine propulsion assemblies with a pair of propellers driven by a single engine are known and have been in use for many years. For example, Krause U.S. Pat. No. 3,112,728 discloses a Twin Screw Power Motor Boat and Transmission Control. As disclosed, an internal combustion engine, a reduction gear and a drive shaft incorporate a bevel gear assembly in mesh with a pair of spaced bevel gears secured on the ends of a respective input shaft journaled and projected into a pair of transmissions.

A more recent U.S. Pat. No. 3,924,557 of Bloch discloses a propeller mechanism for boats, As disclosed, the device consists of two shafts attached to a gear mechanism which is enclosed in cowlings mounted opposite each other on the hull of a boat. Propellers are mounted on the shafts, in addition, supports are provided attached to the splash board which also support two rudders mounted behind the propellers. The gear mechanism is connected to a motor controller located inside of the boat.

Finally a Multi-Propeller Drive System is disclosed in Belenger, U.S. Pat. No. 5,413,512. As disclosed the system includes a single input shaft for connection to an engine, a differential gear assembly for directing the driving force from the input shaft between a pair of output shafts and a pair of laterally spaced propellers driven by the output shafts of the differential gear assembly. The differential gear assembly operates in a manner wherein one output shaft if required is permitted to revolve at a different speed than the other output shaft. A pair of brake mechanisms acting on the output shafts of the differential gear assembly enables an operator to control the rotational speed of the respective propellers without modifying the engine speed or transmission setting Notwithstanding the above, it is presently believed that there is a need and a potential commercial market for an improved marine propulsion assembly in accordance with a preferred embodiment of the present invention. There should be a demand for such assemblies because they power twin propellers with a single engine to reduce the cost for a second engine, reduce the load or weight on the boat and possibly conserve fuel. Also, it is believed that the unique design of the propellers increase thrust and enhance the triple mechanism of the marine propulsion assembly.

BRIEF SUMMARY OF THE INVENTION

In essence, the present invention comprises or consists of a marine engine, an inboard, outboard or inboard with outboard drives and a pair of parallel laterally spaced propeller shafts, a pair of marine propellers with one'of the propellers fixed to each of the shafts are also provided for rotation in opposite directions by the marine engine. In the present invention each of the propellers includes a rotatable hub and four equally spaced outwardly extending concave blades. The hub includes a first or forward portion having the shape of a frustum of a cone with a decreasing radius from a forward edge thereof to the middle of the hub. The hub also includes a second or rear section continuous with the first frustum of a cone and having a shape of a frustum of a cone with an increasing radius from the middle of the hub to a rear edge thereof The base and top of the cone are of equal sizes. In other words one cone is a mirror image of the other cone. In addition, each of the equally spaced blades have a complex concave arcuate shape wherein a leading side of one of the propeller blades face a leading edge of one of the blades of the other of the propeller blades and are spaced apart by a distance of less than ½ the length of one of the blades.

The invention will now be described in connection with the accompanying drawings wherein like reference numerals have been used to indicate like parts.

DESCRIPTION OF THE PREFERRED EMBODIMENTS OF THE INVENTION

Figure 1:
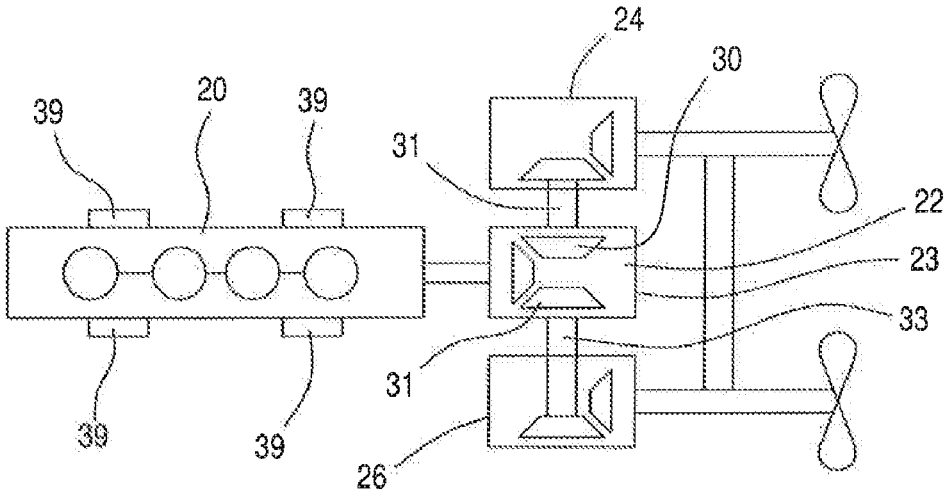
FIG. 1 is a schematic view of a dual prop single engine drive mechanism wherein the propellers are rotated in opposite directions.
Figure 6:
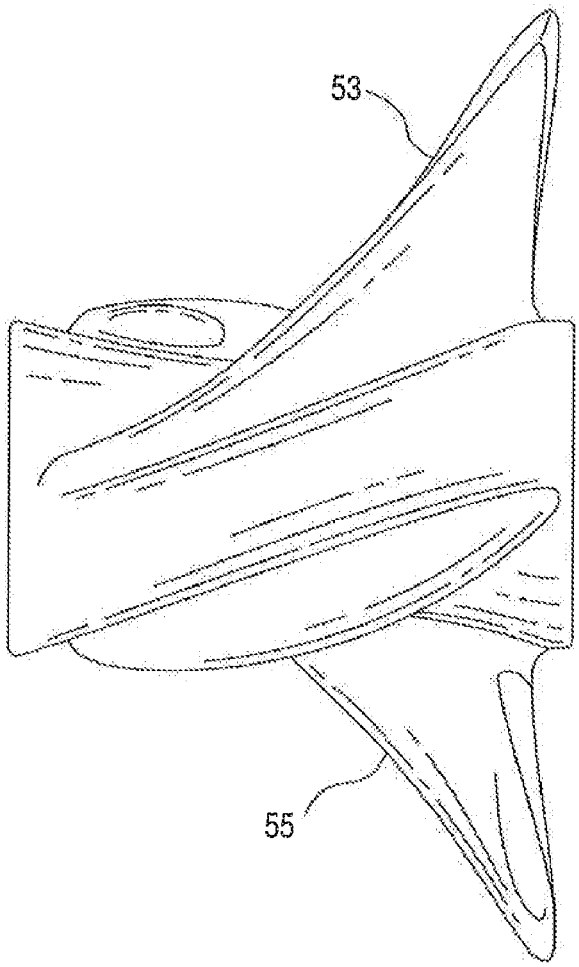
FIG. 6 is an enlarged view of a single propeller in accordance with a preferred embodiment of the present invention.
Figure 2:
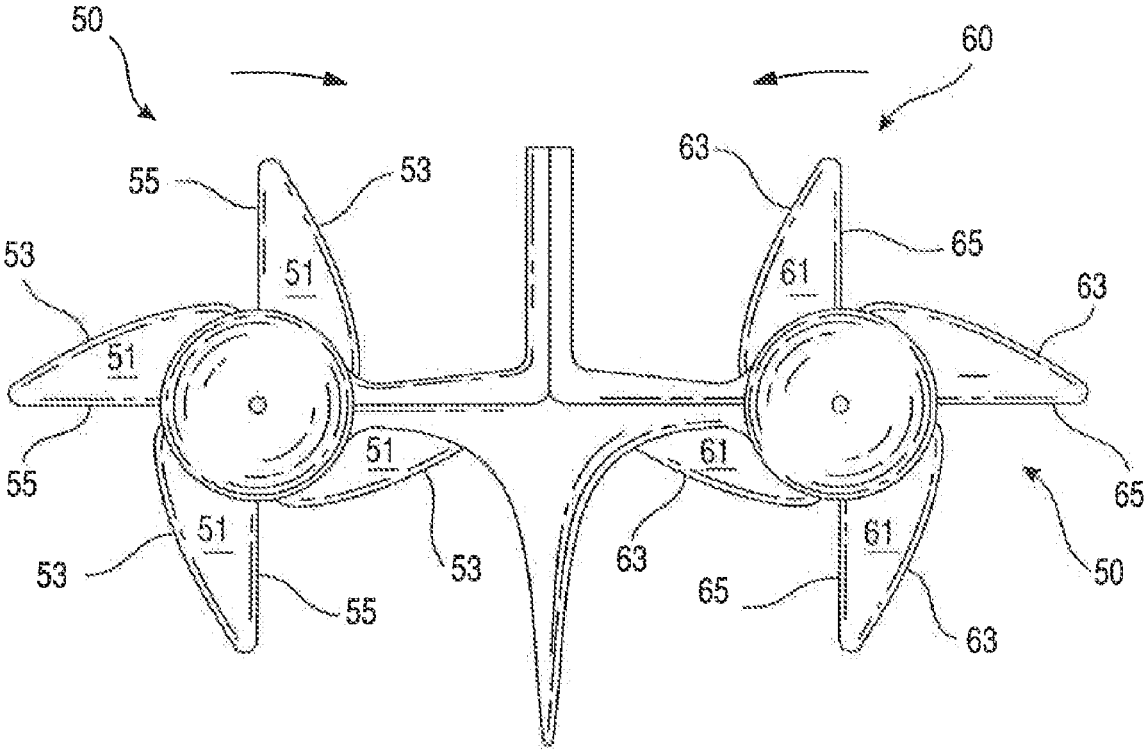
FIG. 2 is a front elevational view of a pair of propellers in accordance with the present invention.
Figure 3:
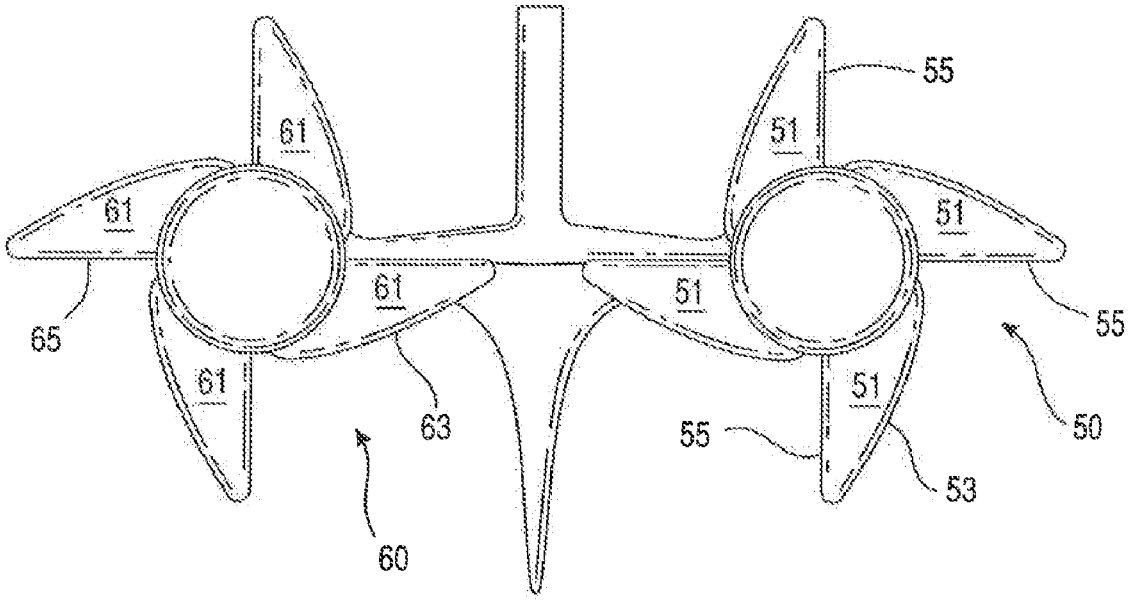
FIG. 3 is a rear elevational view of the propellers shown in FIG. 2.
Figure 4:
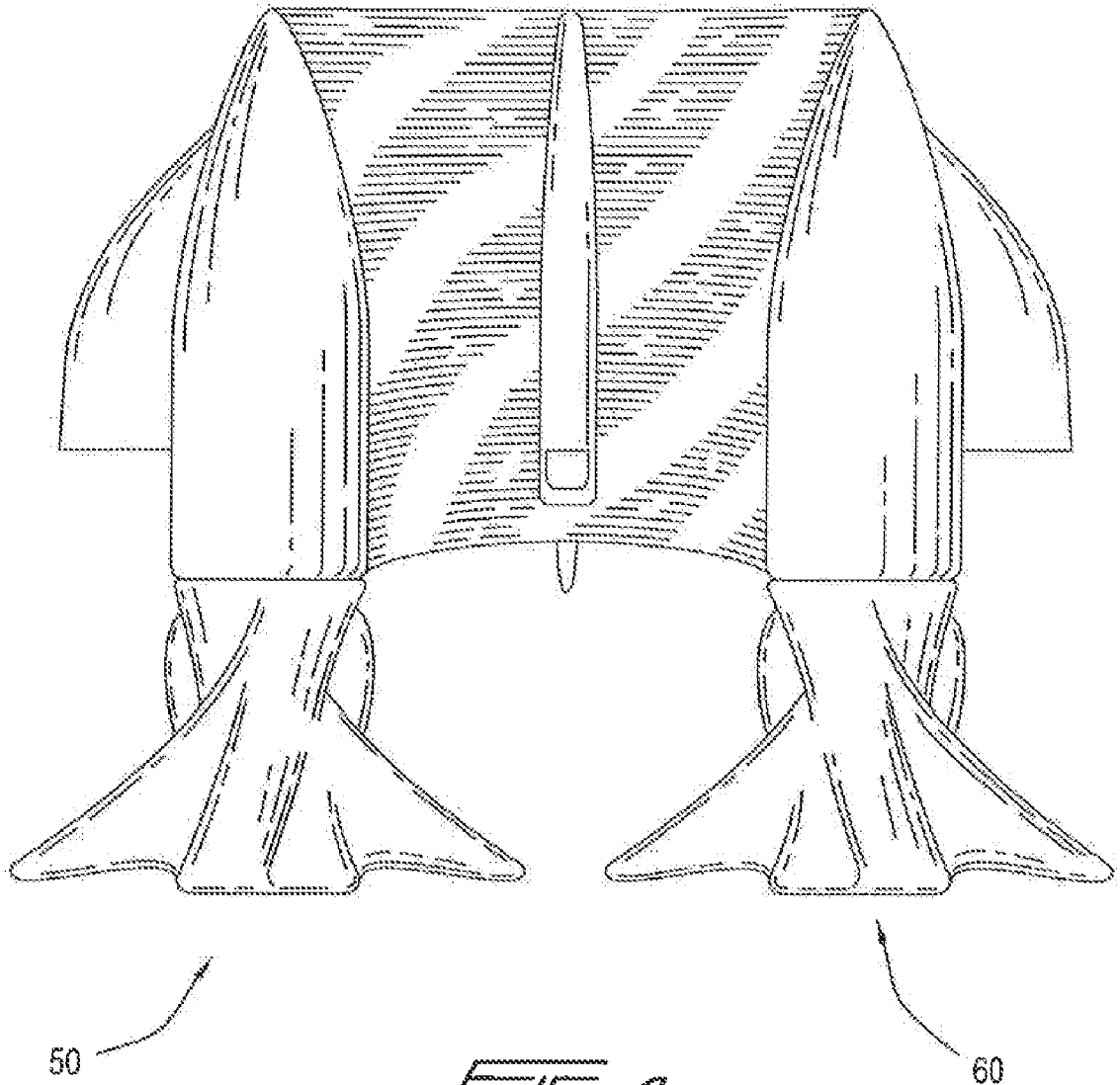
FIG. 4 is a top or plan view of the propellers shown in FIGS. 2 and 3.
Figure 5:
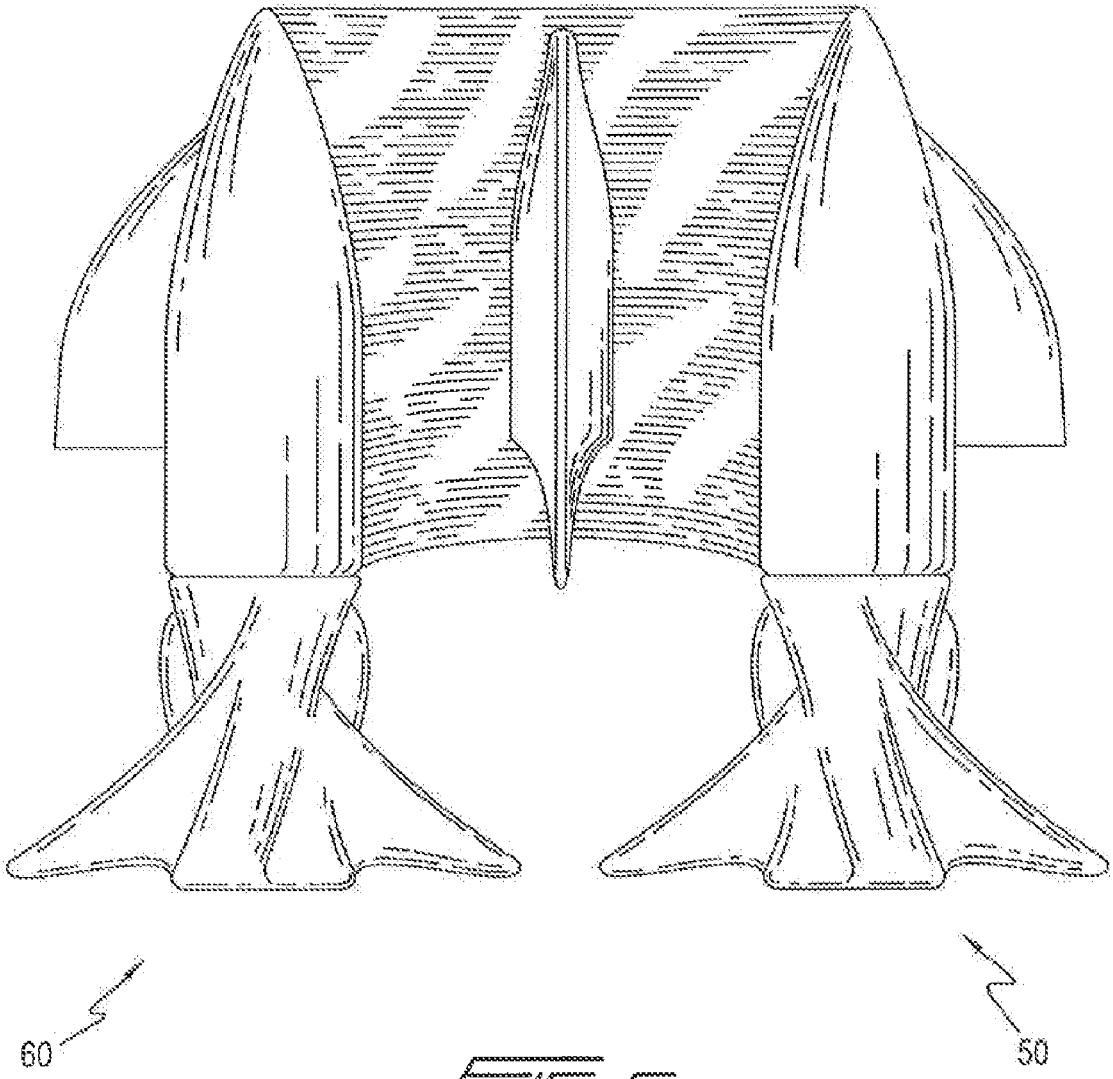
FIG. 5 is a plan view taken from the bottom of the propellers shown in FIGS. 2-4.

As illustrated in FIG. 1, a marine propulsion assembly includes an inline four cylinder engine 20 or other power unit mounted in the hull (not shown) of a boat. The engine 20 is coupled to a drive system that includes a primary gear box 22 and a pair of opposed outboard gear boxes 24 and 26 one on each side of the engine 20. The outboard gear boxes 24 and 26 are driven by the primary gear box 22 having a u-shaped arrangement of bevel gears.

The primary gear box 22 includes a housing 23 having a U-shaped configuration gear assembly that includes a first bevel gear 30 and a pair of oppositely rotating bevel gears 31 and 32. The bevel gear 30 is connected to and driven by the engine 20. The housing 23 also includes two bevel gears 31 and 33 that are meshed with the first bevel gear 30 and driven thereby. The two bevel gears rotate associated split shafts 33 and 35 in opposite directions. The split shafts 32 and 35 are provided rather than having a universal joint or other coupling to allow for misalignment between the gear boxes and to keep the distance between the shafts 34 and 36 as narrow as possible. The three gear boxes 22, 24, and 26 are each mounted on a rugged support such as an I-beam or channel member disposed transversely of the boat's hull (not shown) and holds the assembly completely ridged.

The three gear box units 22, 24 and 26 are operatively connected to the marine engine 20 using an engine adapter and the entire assembly is counter levered from the engine which is mounted on four engine mounts 39. This allows the gear box to move with the engine within the limits of the engine mounts movement, The stern drive units 40 and 41 are commercially available units and are rotated in opposite directions by the first bevel gear 30 acting on the two associated beveled gears to thereby rotate propellers 40' and 41'.

The details of the above identified assembly may be compared with the references in U.S. Pat. Nos. 7,442,103 or 5,413,512, both of which are incorporated herein in their entirety by reference.

In the aforementioned references, the propellers rotate in the same direction while in the present invention they rotate in opposite directions i.e. inwardly toward one another. Each of the propellers 50 and 60 include a rotatable hub 50' and 60' having a first forward portion and a second or rear portion, The first portion has the shape of a frustum of a cone with a decreasing radius from a forward edge of the edge of the hub to the middle of the hub along the axis of rotation, The second or rear portion is continuous with the first portion and provided with an increasing radius from the middle of the hub to the rear of the hub. The bases of the hubs and tops of the hubs are of equal size. in other words, one frustum of a cone is a mirror image of the other. As illustrated in FIGS. 2-6, each of the two propellers 50 and 60 respectively include four blades 51 and 61 respectively. Each of the blades of each propeller includes a leading edge 53 and 63 respectively and a trailing edge 55 and 65 respectively. The propellers 50 and 60 are rotated in opposite directions i.e. the one on the left rotates in a clockwise manner while the one on the right rotates in a counter-clockwise direction.

The leading edges of each of the blades 53 and 63 of the propellers 51 and 61 curves upwardly and forwardly in the direction of rotation and from a forward portion of the hub toward the rear of the hub and the vane defines a concave portion facing in the direction of rotation while the trailing edge forms a relatively straight line with a slight forward angle with respect to a perpendicular line with respect to the axis of rotation and with a curved end into a rear portion of said hub.

While the invention has been described in connection with its preferred embodiments it should be recognized that changes and modifications may be made therein without departing from the scope of the appended claims.

What is claimed is:

1. A marine propulsion assembly comprising;

a marine engine, a pair of parallel laterally spaced propeller shafts and a pair of marine propellers with one of said propellers fixed to each of said shafts for rotation in opposite directions by said marine engine each of said propellers includes a hollow hub and four equally spaced blades and wherein said hub having a forward or first portion having the shape of a frustum of a cone with a decreasing radius from a forward edge thereof to a middle of said hub and a rear or second continuous portion having a shape of a frustum of a cone with an increasing radius from the middle of said hub to the rear of said hub and wherein the base or largest diameter of the frustum of the cones are of equal size; and wherein each of said equally spaced blades having a complex concave shape wherein an arcuate leading edge curves outwardly and upwardly at a reduced radius from a shallow forward portion of said hub to an outwardly extending rear portion with a relatively straight trailing edge that is generally perpendicular to the axis of rotation and wherein the leading edge of one of said propellers face the leading edge of the other of said propellers but spaced apart therefrom by ½ or less of the height of the trailing edge of said blade.

2. A marine propulsion assembly according to claim 1 which includes means for reversing the direction of rotation of one of said propellers with respect to the direction of rotation of the other of said propellers whereby each of said two propellers are driven in opposite directions.

3. A marine propulsion assembly according to claim 2 in which the distance separating the outer extremity of one of said blades of one of said propellers from the outer extremity of a blade in a second propeller is about ⅓ of the height of a blade from a central axis of said propeller shaft.

4. A marine propulsion assembly according to claim 2 in which said hub includes a generally flat closed rear surface that is generally perpendicular to the axis of rotation.

5. A marine propulsion assembly according to claim 4 which includes a single rudder between and below said axis of rotation of said propellers.

6. A marine propulsion assembly according to claim 5 which includes a single rudder between and below said axis of rotation of said propellers.

7. A marine propulsion assembly according to claim 6 in which said marine engine is an inboard engine.

8. A marine propulsion assembly according to claim 6 which includes an inboard/outboard drives between said marine engine and said propeller shafts.

9. A marine propulsion assembly according to claim 6 in which said marine engine is an outboard motor.

10. A marine propulsion assembly consisting of:

an inboard marine engine, an inboard/outboard drive, a pair of parallel laterally spaced propeller shafts and a pair of marine propellers with one of said propellers removeable fixed to each of said shafts for rotation in opposite directions by said marine engine; and wherein each of said propellers including a hub having an axis of rotation and four radially extending, equally spaced concave blades and wherein said hub having a forward portion in the shape of a frustum of a cone with a decreasing radius from a forward edge thereof to a middle of said hub and a rear or second continuous portion in the shape of a mirror image of said first portion with an increasing radius from the middle of said hub to the rear of said hub; and each of said four equally spaced blades having a complex concave shape with an arcuate leading edge curving outwardly or upwardly with a relatively straight trailing edge that is generally perpendicular to the axis of rotation and where the leading edge of one of said blades of one of said propellers when aligned with the leading edge of one of said blades of the other of said propellers are spaced from one another by a distance of less than ½ of the height of one of said blades from the axis of rotation.

11. A marine propulsion assembly according to claim 10 in which the leading edge of each vane curves upwardly and forwardly in the direction of rotation and from a forward portion on said hub to a rear portion of said hub and wherein the vane defines a concave portion facing in the direction of rotation while the trailing edge forms a relatively straight line with a slight angle with respect to a perpendicular line from the axis of rotation and with a curved end into a rear portion of said hub.

* * * * *